US005855705A

United States Patent [19]

Gauthier

[11] Patent Number: 5,855,705

[45] Date of Patent: Jan. 5, 1999

[54] ARTIFICIAL CHRISTMAS TREE

[76] Inventor: Ray Gauthier, 367 Elmgrove Drive, Tecumseh, Ontario N8N 4H1, Canada

[21] Appl. No.: 623,996

[22] Filed: Mar. 29, 1996

[51] Int. Cl.[6] ..... A47G 33/06

[52] U.S. Cl. ..... 156/61; 428/18

[58] Field of Search ..... 428/18, 19, 20; 362/123; 156/60, 61

[56] References Cited

U.S. PATENT DOCUMENTS

| | | | |
|---|---|---|---|
| D. 326,626 | 6/1992 | McKnight | D11/118 |
| D. 329,826 | 9/1992 | Taylor | D11/124 |
| 3,296,430 | 1/1967 | Eckert | 428/20 X |
| 3,544,783 | 12/1970 | Williams, Sr. | 428/20 X |
| 3,617,732 | 11/1971 | Fisher | 428/18 X |
| 3,928,689 | 12/1975 | Mottel | 428/20 X |
| 4,012,631 | 3/1977 | Creager | 362/252 |
| 4,161,768 | 7/1979 | Gauthier et al. | 428/20 X |
| 4,447,279 | 5/1984 | Boisvert et al. | 156/61 |
| 4,451,510 | 5/1984 | Boisvert et al. | 428/20 X |
| 4,679,126 | 7/1987 | Van Sickler | 362/226 |
| 4,748,058 | 5/1988 | Craig, Jr. | 428/18 X |
| 4,789,570 | 12/1988 | Maddock | 428/20 X |
| 4,943,899 | 7/1990 | Tseng | 362/226 |
| 5,001,615 | 3/1991 | Stefanelli | 362/226 |
| 5,034,658 | 7/1991 | Hiering | 362/123 X |
| 5,057,976 | 10/1991 | DuMong | 362/123 |
| 5,103,380 | 4/1992 | Lindner et al. | 362/123 X |
| 5,455,750 | 10/1995 | Davis et al. | 362/123 |

OTHER PUBLICATIONS

Pre–Strung Lighted Christmas Tree, as advertised on p. 85 of the 1995 Gift catalog of Hammacher Schlemmer.

Assembly Instructions for the Mountain King® Christmas Trees, furnished by the American Tree Company.

Assembly Instructions for the Silverstri® Ready–Lit™ Christmas Tree, furnished by Silvestri Corporation, Chicago, IL 60614.

*Primary Examiner*—Henry F. Epstein
*Attorney, Agent, or Firm*—Chupa and Alberti, P.C.

[57] ABSTRACT

An artificial Christmas tree 10 having several branch segment assemblies 14–18 is disclosed, and further having electrically activated lights 46, 48, and 50 which are predisposed or preassembled upon the tree. Also disclosed is a method for automatically winding or placing the lights upon tree 10.

1 Claim, 5 Drawing Sheets

ARTIFICIAL CHRISTMAS TREE

FIELD OF THE INVENTION

This invention relates to an artificial Christmas tree, and more particularly, to an artificial Christmas tree having electrically actuated lights predisposed upon and/or fixed upon and/or fixed and removably deployed on the various unassembled portions thereof, thereby obviating the need for a user of the tree to "string" or place lights on the assembled tree, and according to a second aspect of the invention, to a method to automatically place or assemble electrically actuated lights on an artificial Christmas tree or on various preselected portions of the tree.

BACKGROUND OF THE INVENTION

Artificial Christmas trees are becoming very popular since they only require a "one-time" purchase, thereby obviating the need for annual or yearly purchases of Christmas trees, prices of which have gone up dramatically in prior years. Moreover, these artificial Christmas trees are generally becoming more popular since they require less or no maintenance such as watering, are not as great a fire hazard as are "real trees", and do not shed needles or other such materials which causes the surrounding area to become unsightly or unkept, and obviate the need to harvest or destroy valuable timber stock.

While these artificial Christmas trees are becoming popular, they suffer from some drawbacks. For instance, and without limitation, many of these prior artificial Christmas trees are very difficult to assemble, are relatively bulky to store, and require a user or owner to "string" or physically place lights upon the tree, thereby requiring the same sort of undesirable light placement activity as do the "real trees". Applicant has found it to be highly desirable to have the electrically actuated lights predisposed or mounted upon the unassembled tree portions in order to obviate the need for a user to "string" or place the lights thereon, once the tree is assembled.

There is therefore a need for, and it is a principal object of this invention to provide, an artificial Christmas tree which overcomes the aforedescribed drawbacks of the prior art and which has electrically powered lights disposed thereon, thereby obviating the need for a user to string or place electrically powered lights on the tree after it is installed and assembled.

SUMMARY OF THE INVENTION

According to a first aspect of the present invention, an artificial Christmas tree is provided which overcomes many of the deficiencies of the prior art and which has many advantages over a "real tree".

According to a second aspect of the present invention, an artificial Christmas tree is provided having several unassembled portions each having electrically powered lights predisposed or removably connected thereon.

According to a third aspect of the present invention an artificial Christmas tree is provided which is relatively easy to assemble, which is not bulky but is made to store relatively easily and in a relatively compact manner, and which is relatively low in cost.

According to a fourth aspect of the present invention, an artificial Christmas tree is provided which includes a stem or trunk portion; a first branch removably connected to the stem or trunk portion; a second branch removably connected to the stem or trunk portion; electrical power means substantially traversing the stem or trunk portion for providing and distributing electrical power; a first set of electrically powered lights connected to the first branch; a second set of electrically powered lights connected to the second branch; and connection means for electrically connecting the first and second sets of electrically powered lights to the electrical power means whereby, the first and second sets of the electrically powered lights are activated by the electrical power means.

According to a fifth aspect of the present invention, a method is provided for placing, in an automated manner, the electrically powered lights upon the artificial Christmas tree branches. In embodiment this method includes the steps of:

providing a first electrical conductor having substantially identical electrical lights at each opposed end thereof, each of said opposed ends further having a grommet portion, each of said grommet portions being adapted to be placed upon a unique one of opposed ends of a first branch segment and slid a certain distance along said first branch segment;

providing a second electrical conductor having substantially identical electrical lights at each opposed end thereof, each of said opposed ends further having a grommet portion, each of said grommet portions being adapted to be placed upon a unique one of said opposed ends of a second branch segment and slid a certain distance along said second branch segment;

providing a third electrical conductor having an electrical light and a grommet at a first end, said grommet being adapted to be placed upon a first end of said trunk and slid a certain distance along said trunk;

electrically connecting said first electrical conductor, said second electrical conductor, and said third electrical conductor;

rotating each of said first and said second branch segments, thereby tightening and twisting said first and said second electrical conductor around said respective first and second branch segments; and cutting a certain amount off of each end of each of said first and second branch segments.

These and other features, objects, and advantages of the present invention will become apparent from a reading of the following detailed description of the invention, by reference to the attached drawings, and by reference to subjoined claims included in this application for patent.

DETAILED DESCRIPTION OF THE PREFERRED EMBODIMENT OF THIS INVENTION

Figure 1:
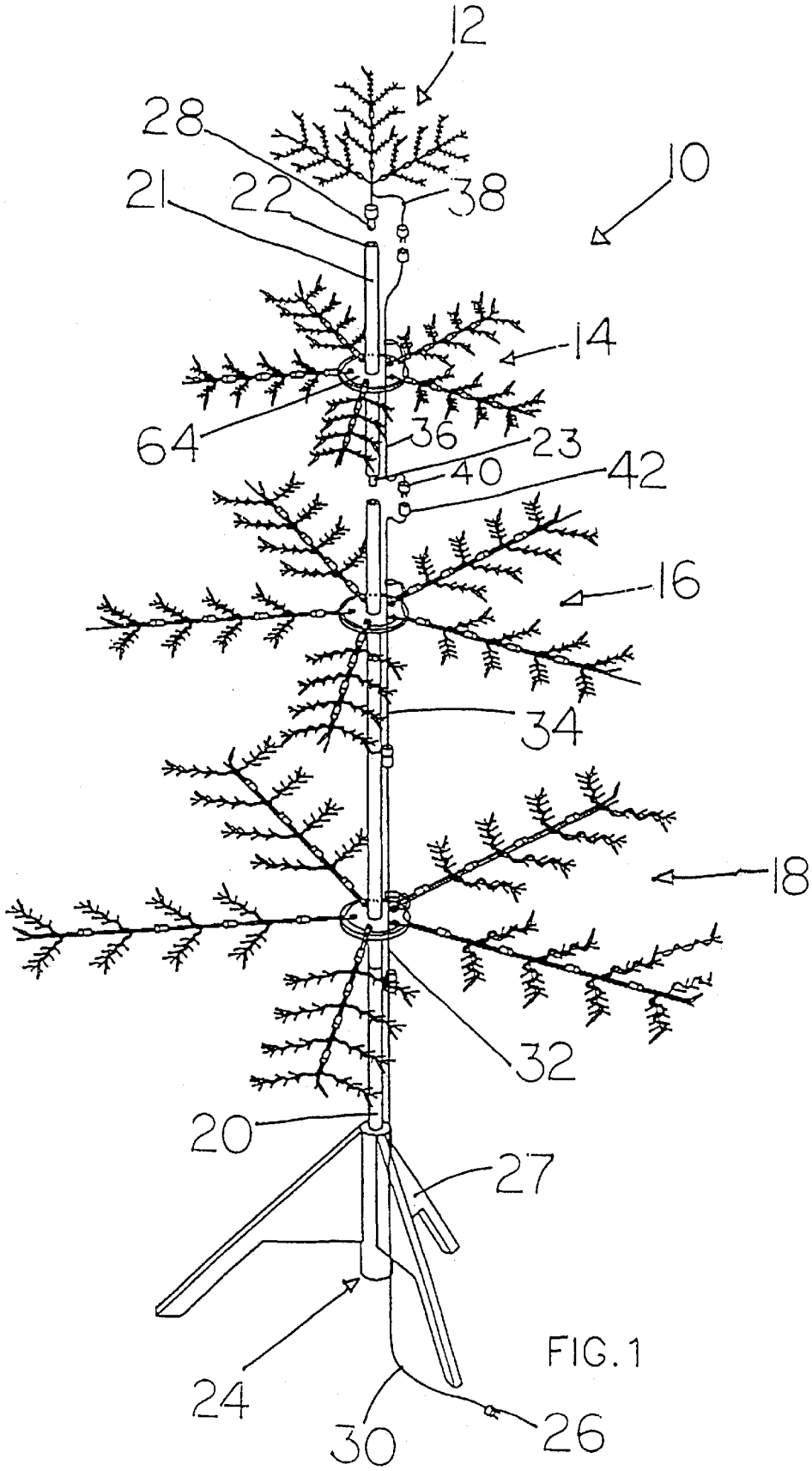
FIG. 1 is a perspective partially assembled view of an artificial Christmas tree made in accordance with the teachings of the preferred embodiment of this invention.

Referring now to FIG. 1, there is shown an artificial Christmas tree 10 made in accordance with the teachings of the preferred embodiment of this invention. Particularly, as shown, artificial Christmas tree 10 includes several branch segment assembly portions 12, 14, 16, and 18 which are adapted to be removably secured or joined together in a manner which allows a single longitudinal stem or trunk 20 to be formed by their interconnection. Each assembly 12–18 includes several branches which may be made from commercially available wire and have green colored conventional plastic or commercially available composite material to simulate tree branches. That is, each assembly 14, 16, and 18 includes a trunk portion, such as 21 of assembly 14, having a hollow and generally circular top orifice portion 22 and a solid generally rounded male protruding opposed bottom portion 23 having a diameter slightly smaller than the diameter of the orifice portion 22 and which is adapted to frictionally engage and be seated within a unique one of the orifices 22. That is, each orifice 22 of each segment 14, 16, and 18 is substantially similar, in one embodiment, and each portion 23, in one embodiment of each segment 14, 16 and 18 is also substantially similar. In this manner, trunk portion segments 21 of branch segment portions 14, 16, 18 are removably joined together to form continuous trunk 20 which may be made of wood, metal, or some other known and commercially available composite material. Moreover, in this manner segment portions 12–18 may be relatively quickly and easily disassembled and stored in a relatively compact manner. The wood or composite trunk and wire branch construction reduces cost and makes assembly 10 relatively low cost.

Trunk 20 is, in the preferred embodiment of this invention and as shown in FIG. 1, removably and fixedly received in a tree stand 27 which may be decorated in an conventional and known manner. Stand 27 may be of any desirable shape and size provided that it supports trunk 20 and the various segments 12–18, and may be made of wood, metal, or some other known composite material. Moreover, an "electrical power means" or "electrical distribution means" or electrical source 24 is included in the tree assembly of the preferred embodiment of the invention and is adapted to include an electrical receptacle type plug 26 which is adapted to be removably and fixedly secured into a standard electrical power outlet (not shown). Source 24, in one embodiment, comprises a two conductor sheathed cable which substantially traverses outside of and over the entire length of trunk or stem portion 20 although, in a second embodiment source 24, may be fitted or threaded inside of trunk 20 and removed from sight.

That is, as shown, in one embodiment, to facilitate relatively easy storage and assembly/disassembly of tree 10, the electrical power/distribution means 24 may itself be selectively assembled/disassembled. More particularly, in one embodiment, means 24 is formed by the selective assembly of two or dual conductor cable portions 30, 32, 34, 36, and 38. Portions 32, 34, and 36 each have substantially identical first male ends 40 having two metal conducting extension members, each of which is electrically coupled to a unique one of the conductors of means 24, and substantially identical second opposed female ends 42 which are similarly electrically coupled to a unique one of the conductors of means 24. Ends 40 of each segment 12–18 are adapted to mate with corresponding ends 42 of the segment physically adjacent and physically below that of the mating end 40, to ensure electrical continuity of cable distributor 24. That is, in one embodiment, end 40 of segment 36 mates with end 42 of segment 34 and end 40 of segment 34 mates with end 42 of segment 32. Portion 38 includes only a male end which mates with the female end of portion 36 and the male portion of segment 32 mates with a female connector of portion 30, which has the plug 26 integrally connected thereto and integrally 4 formed therein. In this manner, as should be apparent to one of ordinary skill in the art, the electrical distribution means 24 may be relatively quickly and easily disassembled for efficient storage and is of a "quick connect" assembly. It should further be realized by one of ordinary skill in the art that the number of cable portions 32–38 may vary as well as the number of branch segment portions 12–18, while still being encompassed by the spirit and scope of the invention.

Moreover, branch segment 12 is adapted to be placed at the top of trunk or stem portion 20, and particularly, includes a male plug 28 which is adapted to removably secured into orifice 22 of the hollow trunk or stem portion of assembly 14. In one embodiment, the size and shape of plug 28 is substantially similar to portion 23. The manner in which electrically activated light bulbs are fixed and/or removably disposed upon branch segment assemblies 12, 14, 16, and 18 and the manner in which electrical power is distributed to these various assemblies will now be discussed.

Figure 2:
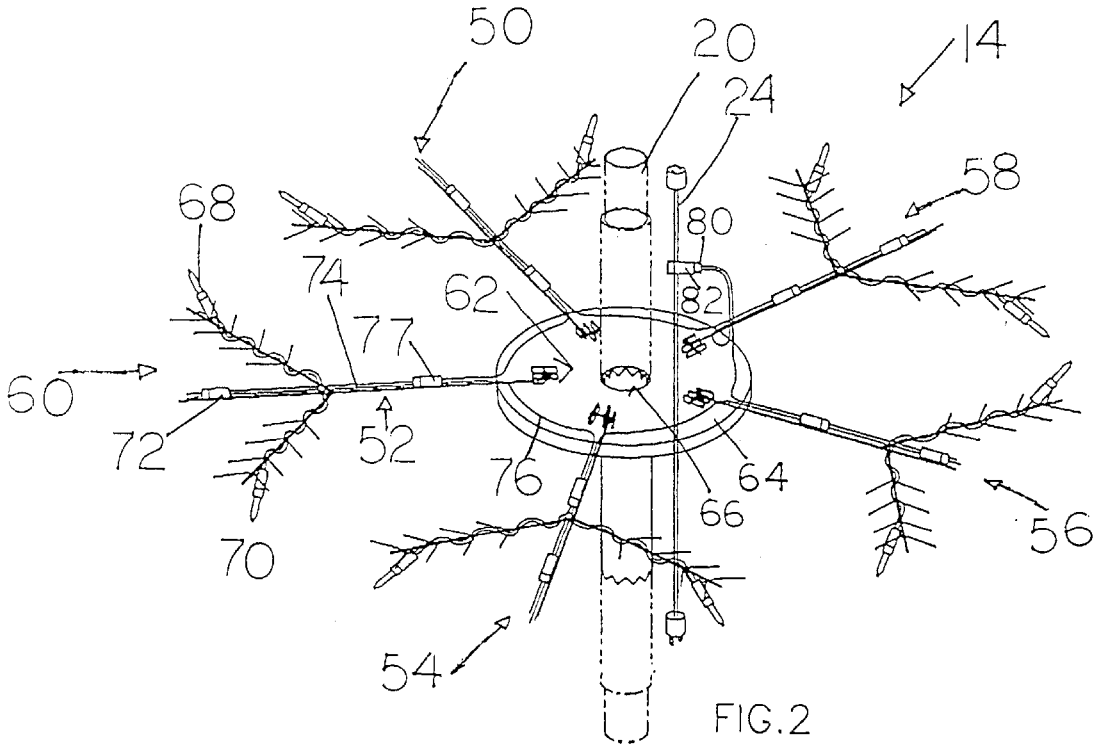
FIG. 2 is a perspective cut-away view of that portion of the tree shown in FIG. 1 and designated by reference arrow "16"

As shown best in FIG. 2, branch assembly 14 includes branch segments 50, 52, 54, 56, and 58. As shown, each of the branch segments 50–58 includes a first generally "Y" shaped end portion 60 and opposed second generally "L" shaped end portion 62 which is adapted to be removably secured to the surface of generally rounded plate 64 having an opening 66 which allows the plate 64 to removably and frictionally secure to the assembled trunk 20.

It should be understood by those of ordinary skill in the art that while the preceding and foregoing discussion centered and centers upon branch assembly 14, the discussion applies equally to and is fully and completely descriptive of the other branch assembly portions 16 and 18 and that, in one embodiment, the branches forming the generally "Y" shaped end portion 60 may be moveable from the illustrated generally "Y" shaped position to a second position in substantial contact with light 72 in order to facilitate compact storage.

Figure 3:
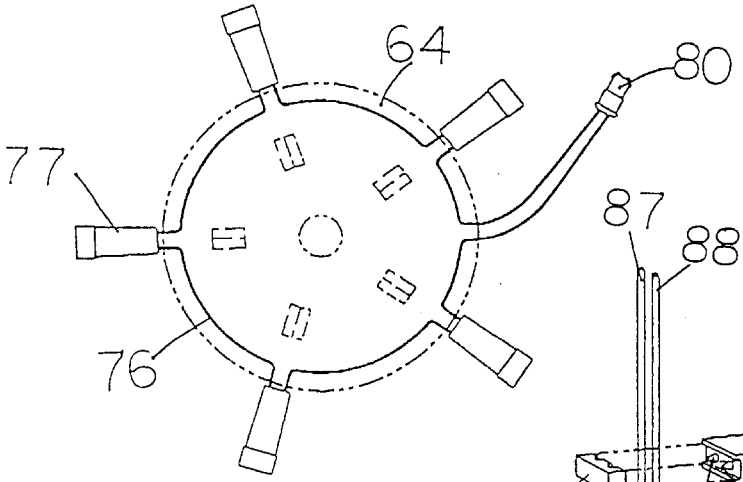
FIG. 3 is a schematic top view of the view in FIG. 2.
Figure 4:
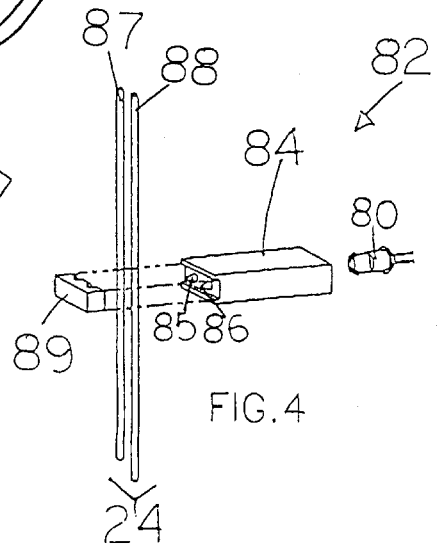
FIG. 4 is a perspective unassembled view of one of the electrical connection means shown in FIG. 1 and further shown in unassembled relation to the electrical distribution means which is also shown in FIG. 1.

As further shown in FIGS. 1 and 2, in one embodiment, each branch segment 50–58 includes a first and second electrically actuated light 68, 70 on each end of the "Y" shaped end portions 60 and a third electrically actuated light 72 on the end of the branch segment geometrically bisecting the "Y" shape formed by end portion 60 and which is distally positioned from plate 64. Each of the lights 68, 70 and 72 are electrically connected or "coupled together" by means of an electrical conductor 74 which is attached and electrically coupled to a conductor 76, disposed upon and around the surface of generally rounded plate 64 by use of connector 77. Each of the corresponding electrical conductors 74 of each of the segments 50, 52, 54, 56 and 58 are similarly electrically coupled together upon the rounded surface 64 and are then electrically coupled to a male connector 80 which is electrically coupled to the electrical power distribution means 24 by means of a connector assembly 82. This connection is best shown in FIGS. 3 and 4. It should be realized by one of ordinary skill in the art that the number of electrically actuated lights appearing on branch segments 50, 52, 54, 56 and 58 may vary depending upon, without limitation, such items as the wattage of each light, the amount of electrical power provided by distribution means 24, and upon the number of distribution plates 64 and connectors 80, 82 employed by the particular embodiment of the invention.

As best shown in FIG. 4, electrical conductor 82 includes, in one embodiment, a generally rectangular first box portion 84 having protruding and electrically conducting teeth 85, 86 which are adapted to pierce the grounded sheath of the two conductor distribution means 24. That is, each of the male conductors 85, 86 respectfully establishes fixed electrically coupling or continuity with and to a unique one of conductors 87, 88 of cable 24. Rectangular box 84 is then received by portion 89 which allows the conductors 85, 86 to be firmly secured to the conductors 87, 88 of the electrical distribution power means 24 and to protect the conductors 85, 86 from the contact with extraneous material which may adversely affect the established electrical continuity. Male conductor 80, shown best in FIGS. 2–4, is made to fit within conductor 84 and to electrically couple to teeth 85, 86 in order to provide electrical power to each of the electrically actuated lights 68, 70, and 72 of each of the segments 50, 52, 54, 56, and 58 of assemblies 14, 16, and 18 by means of conductors 74, 76, and 77. In similar fashion, the other branch segment assemblies 16 and 18 receive electrical power from electrical power distribution means 24. Electrical power is received to the electrically powered lights of top portion 12 by means of cable 38 which is electrically coupled to electrical power/distribution means 24.

Figure 5:
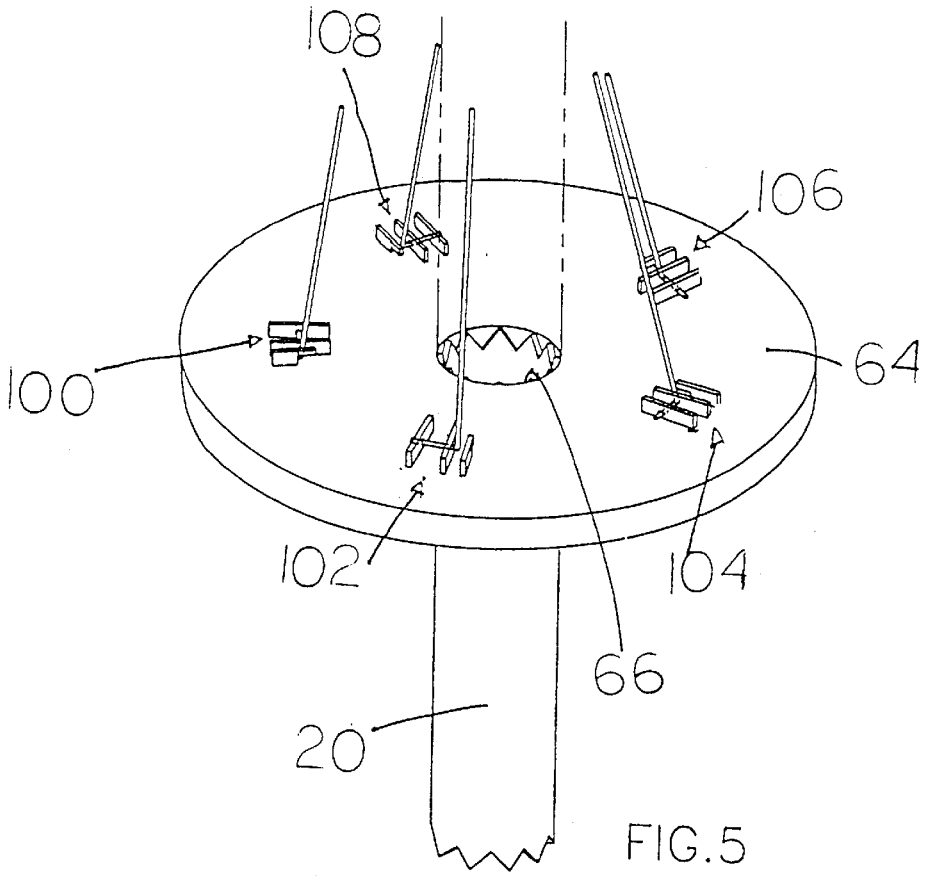
FIG. 5 is a perspective view of one of the plate portions shown in FIGS. 1, 2, and 3 and further illustrating the placement of branch segments disposed thereon.
Figure 6:
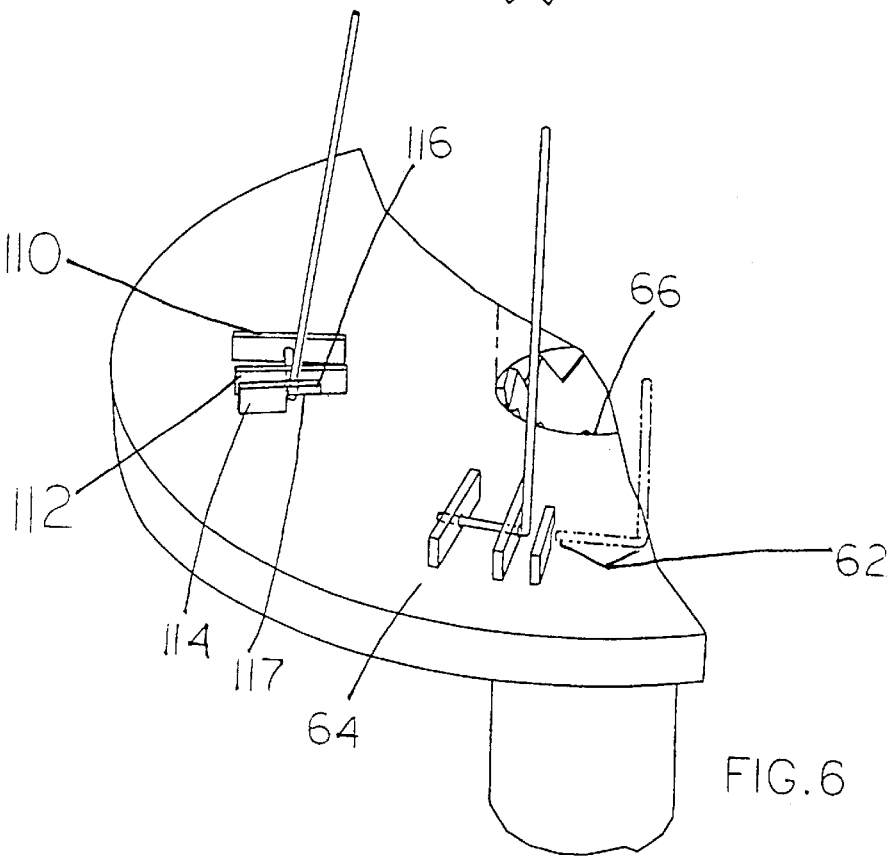
FIG. 6 is a perspective cut-away view of the plate portion shown in FIG. 5 and further showing the manner in which the various branch segments are placed or deployed upon the plate portion.

Referring now to FIGS. 5 and 6, there is shown and illustrated one method by which each of the branch segments of each of the branch assembly portions 14–18 are connected onto tree 10, and more particularly, onto corresponding plates 64. Again, it should be realized by one of ordinary skill in the art that while the following discussion illustrates the tree placement of the branch segments of assembly 14, it is equally applicable to the tree placement of the branch segments of each of the other assemblies 12, 16, and 18 as well, and that each of the plates 64 shown in FIG. 1 have a substantially similar branch segment retention means deployed thereon.

As shown, upon each plate 64 there are disposed outwardly protruding wall assemblies 100, 102, 104, 106, and 108 which generally circumvent opening 66 and which are substantially identical, each having two substantially identical and generally rectangular wall portions 110 and 112, and a finger wall portion 114, each of which protrude above the surface of plate number 64. Members 110 and 112 each have an orifice or generally circular opening which frictionally engages and receives the end 62 of the "L" shaped branch portion. Finger 116 allows the "L" shaped branch portion to be placed into the orifices of members 110 and 112 after it passes beneath the ledge 117 of protruding finger member 116. In this manner, the branch, once pulled down upon surface 64 such that the branch extends outward from trunk 20 as shown in FIGS. 1 and 2, portion 114 allows the branch segment to be closely fitted above and onto plate 64 and onto tree 10 without dislodging or dislocating off of the surface of plate 64 since the wall portion of member 114 prevents the end 62 from "slipping out" of the orifices of members 114 and 112 and since these orifices prevent end 62 from moving laterally across plate 64 in the direction toward and away from trunk 20.

Figure 7:
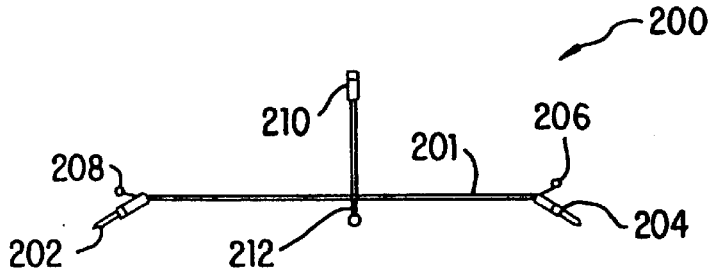
FIG. 7 is a perspective view of one of the electrical conductor assemblies shown in FIG. 1 and adapted to allow electrically powered lights to be placed upon the artificial Christmas tree shown in FIG. 1 and made in accordance with the preferred embodiment of this invention.
Figure 8:
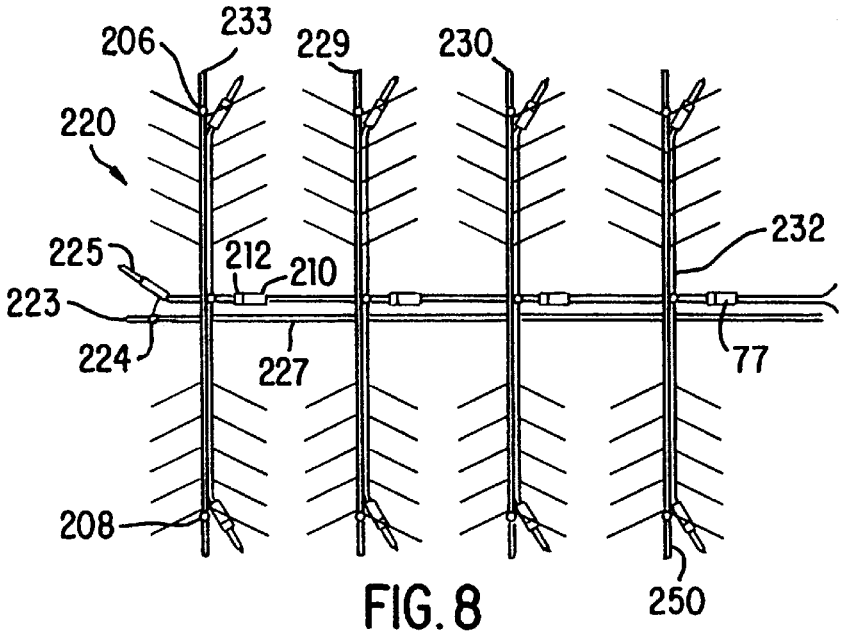
FIG. 8 is a top view of one of the branch segments of the tree shown in FIG. 1 and having electrically powered lights disposed thereon.
Figure 9:
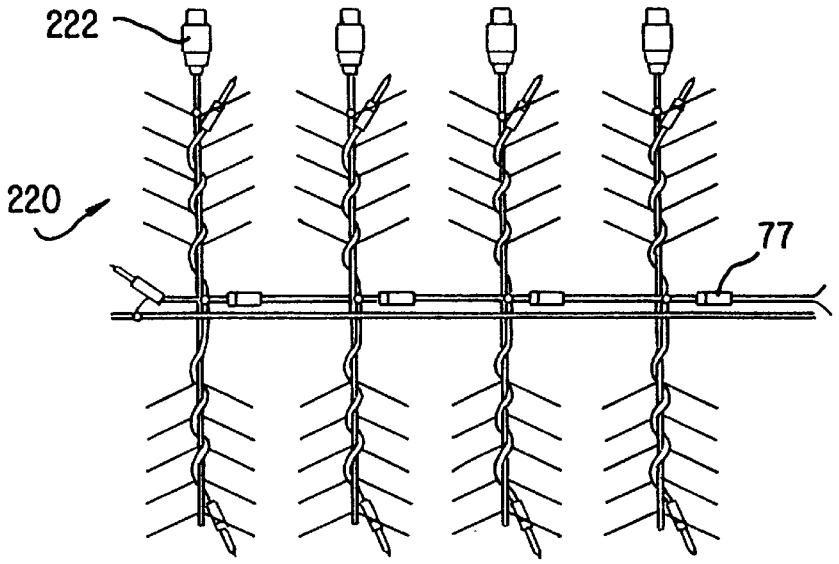
FIG. 9 is a top view of the branch segment shown in FIG. 8, and further showing the twisting of the various branch segments in an manner in which allows the electrical powered lights to be tightly disposed thereon.
Figure 10:
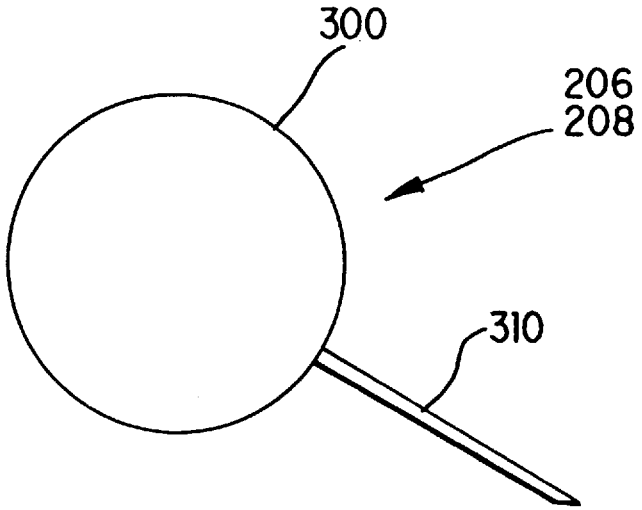
FIG. 10 is a perspective cut-away top view of a grommet portion shown in FIGS. 7, 8 and 9.
Figure 11:
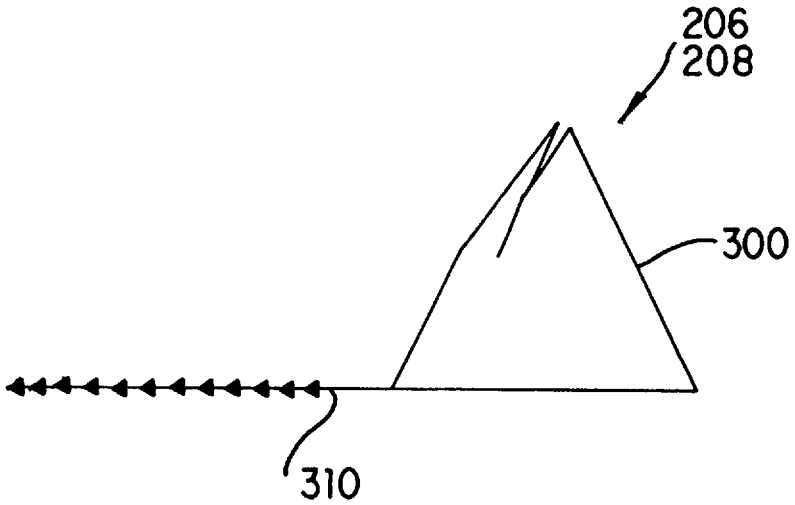
FIG. 11 is a side view of the grommet portion shown in FIG. 10.

Referring now to FIG. 7, 8 and 9 there is illustrated a method of automatically placing the electrically actuated lights upon tree 10, by use of, in one embodiment, of a certain electrically actuated light conductor assembly, such as that shown in FIG. 7. Particularly, as shown in FIG. 7, assembly 200 includes a two-wire sheathed electrical conductor 201 having electrically actuated lights 202 and 204 at opposed ends and outwardly protruding grommets 206 and 208 in close proximity to electrically actuated lights 202 and 204. Assembly 200 further includes a two conductor female conductor 210 and a two conductor male conductor 212 which are placed approximately in the middle, by length, of each of the lights 202 and 204. In the preferred embodiment of the invention, as best shown in FIGS. 10 and 11, each grommet 206, 208 has an open circular portion 300 and a connector portion 310 which couples the open circular portion 300 to assembly 200. The use of conductor assembly 200 to automatically "string" the lights on tree 10 will now be explained.

Each branch segment of each assembly 12–18 has a wiring assembly 200 placed thereon. Particularly, as shown in FIG. 8, grommets 208 and 206 are placed upon opposed ends of each portion of branch segment 220, and slid down the branches. After all branch segment portions 233, 229, 230 and 232 have such an assembly 200 placed thereon, portions 212 are mated with portions 210 of each physically adjacent assembly. Light 225 is placed in portion 210 of the assembly 200 which is placed upon segment portion 233 which will be the greatest distance from plate 64 when properly assembled. Moreover, the assembly used on this segment 233 further includes a grommet 224 which is used to attach this assembly 200 to the main branch segment 227. No such grommet is used on the other branch segment portions, such as branch segment portions 229, 230, and 232 shown in FIGS. 8 and 9. Thereafter, branch segment 220 is placed, in one embodiment, into a fixture and drill 222 twists each branch segment portions 233, 229, 230 and 232 until the lights are tightly coupled directly thereon. Thereafter, each of the exposed ends 250 of each of the branches segment portions are severed or cut, as shown best in FIG. 9.

It is to be understood that the invention is not limited to the exact construction illustrated and described above, but various changes and modifications may be made without departing from the spirit and scope of the invention as set forth in the following claims. Moreover, it should be apparent to one of ordinary skill in the art that what has been disclosed is an artificial Christmas tree which overcomes many of the drawbacks of the prior art and which is, more particularly, relatively easy to assemble/disassemble, is of relatively low cost, is relatively easy to store, and has electrically actuated lights disposed upon the various disassembled portions. It should further be realized that the artificial Christmas tree of the preferred embodiment of the inventor is not limited to or constrained by a particular number of branches or lights, or constrained/limited by a certain lighting or electrical power distributing scheme or technique but that the disclosed concept contemplates a plethora of different and unique lighting and/or power distribution schemes. Moreover, the artificial Christmas tree of this invention is further not constrained or limited by any of the methods employed to automatically place the lights on the branches or branch segments.

I claim:

1. A method for assembling electrical lights upon a branch assembly of an artificial tree, said branch assembly having a plurality of branch segments, each of said plurality of branch segments including a main branch segment portion having a first end adapted to be removably attached to a trunk, a second end, and a plurality of branch segment portions, each of said plurality of branch segment portions respectively having two opposed ends, said method comprising the steps of:

providing a first electrical conductor having two opposed ends and electrical lights at each of said opposed ends, each of said opposed ends further having a grommet portion, each of said grommet portions being adapted to placed upon a unique one of said opposed ends of a first of said plurality of branch segment portions and slid a certain distance along said first of said plurality of branch segment portions;

providing a second electrical conductor having two opposed ends and electrical lights at each of said opposed ends, each of said opposed ends further having a grommet portion, each of said grommet portions being adapted to be placed upon a unique one of said opposed ends of a second of said plurality of branch segment portions and slid a certain distance along said second of said plurality of branch segment portions;

providing a third electrical conductor having an electrical light and a grommet at a first end, said grommet being adapted to be placed upon said second end of said main branch segment portion and slid a certain distance along said main branch segment portion;

electrically connecting said first conductor, said second conductor, and said third conductor;

rotating each of said first and said second of said plurality of branch segment portions, thereby tightening and twisting said first and said second electrical conductor around said respective first and second of said plurality of branch segment portions; and cutting a certain amount off each end of each of said first and second of said plurality of branch segment portions.

* * * * *